United States Patent [19]

Zoor

[11] 4,116,463

[45] Sep. 26, 1978

[54] SKI BINDING

[75] Inventor: Reinhold Zoor, Dachau, Fed. Rep. of Germany

[73] Assignee: Heinrich Wunder KG., Fed. Rep. of Germany

[21] Appl. No.: 745,041

[22] Filed: Nov. 26, 1976

[30] Foreign Application Priority Data

Nov. 29, 1975 [DE] Fed. Rep. of Germany ..... 2553885

[51] Int. Cl.[2] ..... A63C 9/00

[52] U.S. Cl. ..... 280/615; 280/605; 280/618; 280/634

[58] Field of Search ..... 280/618, 617, 615, 614, 280/633, 64, 605

[56] References Cited

U.S. PATENT DOCUMENTS

| | | | |
|---|---|---|---|
| 3,817,712 | 5/1975 | Weckeiser | 280/614 |
| 3,950,001 | 4/1976 | Weigl | 280/618 |
| 4,018,456 | 4/1977 | Gertsch | 280/618 |

FOREIGN PATENT DOCUMENTS

| | | | |
|---|---|---|---|
| 17,179 | 8/1904 | Austria | 280/618 |
| 1,572,250 | 2/1968 | France | 280/614 |
| 292,861 | 7/1916 | Fed. Rep. of Germany | 280/618 |

*Primary Examiner*—Joseph F. Peters, Jr.
*Assistant Examiner*—Milton L. Smith
*Attorney, Agent, or Firm*—Peter K. Kontler

[57] ABSTRACT

A ski binding wherein a rectangular frame of the sole plate has a front portion which is coupled to the ski for pivotal movement about an axis extending at right angles to the skiing direction, and two parallel rearwardly extending arms portions of which extend between the upper and lower sections of a reinforcing device. The latter has two or more extensions with teeth received in selected notches of the arms to hold the reinforcing device at a desired distance from the pivot axis from the frame. One section of the reinforcing device has eyelets for the inwardly extending end portions of a pivotable yoke which engages the sole of a boot in front of the toe portion. The reinforcing device is adjusted lengthwise of the frame in dependency on thickness of the sole which is engaged by the yoke so as to insure that the foremost part of the boot is at or close to the pivot axis for the frame. A torsion spring biases the frame toward the upper side of the ski, and the reinforcing device has a slot for the ledge of a ski climber or non-skid device which is separable from and is located behind the reinforcing device, as considered in the skiing direction.

18 Claims, 7 Drawing Figures

Fig. 3
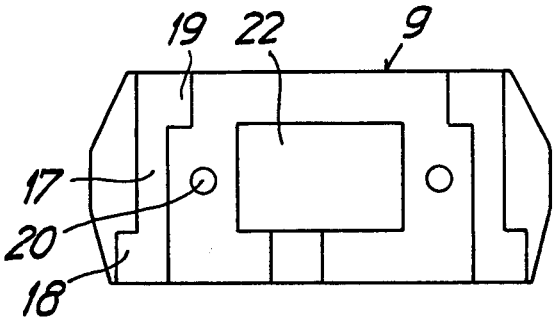
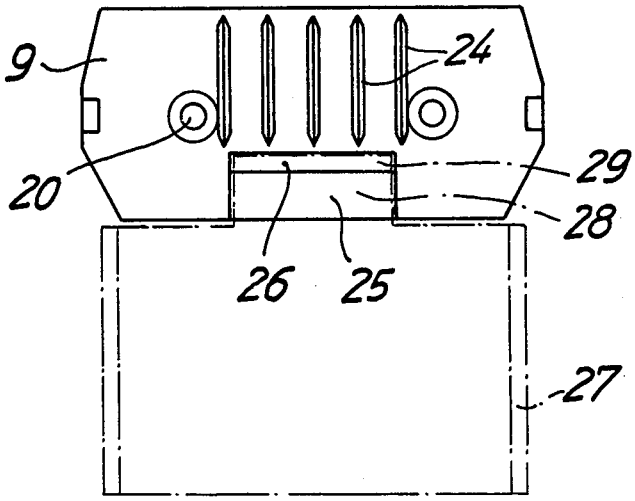
Fig. 4

SKI BINDING

BACKGROUND OF THE INVENTION

The present invention relates to ski bindings in general, especially to bindings for cross country skis, and more particularly to improvements in sole plates of ski bindings. Still more particularly, the invention relates to improvements in the construction of sole plates, in the manner of mounting the sole plates on skis, and in the manner of securing the sole plates to the toe portions of boots.

German Pat. No. 1,578,912 discloses a ski binding wherein the front part of the sole plate is pivotably coupled to the ski and comprises a frame having two longitudinally extending parallel rods which are connected to each other by a transversely extending stiffening member. The stiffening member has two eyelets whose axes are parallel to the skiing direction and through which the rods extend, and serves as a rest for the sole of a boot as well as to enhance the rigidity of the sole plate. Such rigidity is not guaranteed under all circumstances, mainly because the rods simply pass through the eyelets of the stiffening member and are likely to move lengthwise relative to each other and/or the stiffening member, especially if the sole plate is subjected to pronounced twisting stresses, e.g., if the heel of the boot tends to move laterally of the ski.

The sole plate which is disclosed in the German patent further carries a conventional connecting device which engages the foremost portion of the sole of a ski boot in front of the toe. The connecting device is designed to properly engage and hold a sole of average thickness. Furthermore, the just discussed connecting device extends forwardly beyond the pivot means for the sole plate; this limits the angle through which the sole plate can pivot with respect to the ski.

A ski binding, especially a binding for use on cross country skis, should be capable of engaging different types of boots, i.e., not only ski boots but also other types of boots (for example, boots which are designed for mountain climbing). The aforediscussed patented binding is incapable of properly engaging different types of boots, especially when the thickness of the sole deviates considerably from an average thickness. Also, it is desirable to employ a relatively simple but reliable connecting device (e.g., a simple pivotably mounted yoke) which can be moved into satisfactory engagement with the tip of the sole in front of and below the toe portion of the boot. If such a simple yoke engages the tip of a relatively thin sole, the boot is located closer to the front end of the ski than if the yoke engages the tip of a relatively thick sole. This will be readily understood by considering that the yoke is pivotable about a horizontal axis which is normal to the longitudinal direction of the ski. The shape of the toe portion of a boot also affects the angular position of the yoke. In other words, the position of a boot with respect to the pivot axis for the sole plate of the binding depends on the thickness of the sole, and to a certain extent, on certain other factors (including the aforementioned configuration of the toe portion). It can happen that (especially if the sole is very thin) the foremost part of the sole extends forwardly beyond the pivot axis of the sole plate. This interferes with movements of the skier's legs, especially in cross country running. On the other hand, if the tip of the sole is located too far away from the pivot for the sole plate (i.e., if the sole is very thick), the skier must lift the corresponding portion of the ski (and hence his or her weight) through a distance which approximates or equals the distance between the tip of the boot and the pivot axis for the sole plate (such pivot axis should not be confused with the pivot axis for the aforementioned yoke which engages the tip of the sole in front of the toe portion of the boot). It has been found that the boot is located in an optimum position if its tip is closely adjacent the pivot for the sole plate. This is not possible with the binding which is disclosed in the aforementioned German patent, partly due to the (self-releasing) nature and partly due to design of the connecting device which engages the tip of the sole.

OBJECTS AND SUMMARY OF THE INVENTION

An object of the invention is to provide a novel and improved ski binding, especially (but not exclusively) for use on cross country skis, which can be readily adjusted to properly engage and support different types of boots as well as boots having thick, thin or average soles.

Another object of the invention is to provide novel and improved means for reinforcing the frame of the sole plate in a ski binding.

A further object of the invention is to provide a novel and improved sole plate for a ski binding.

An additional object of the invention is to provide novel and improved connecting means for attaching the binding to the tip of the sole on a ski boot or another article of footwear, such as a boot which is intended primarily for mountain climbing.

Still another object of the invention is to provide a binding which is relatively simple, compact and inexpensive, which can be installed on all or nearly all types of skis, which is of lightweight construction but is capable of resisting stresses greatly exceeding maximum permissible stresses upon conventional bindings, and which can be readily manipulated and adjusted by unskilled persons with a minimum of training or demonstration.

An additional object of the invention is to provide a multiple-purpose lightweight reinforcing device for the frame of the sole plate in a ski binding.

An ancillary object of the invention is to provide a reinforcing device which can greatly reduce the magnitude of stresses upon the means for coupling the sole plate to a ski, which can insure an optimum positioning of the tip of a boot relative to the pivot axis for the sole plate, and which can constitute a convenient rest or support for the adjacent portion of the sole of a boot and offers little resistance to shifting of the sole with respect thereto.

A further object of the invention is to provide a reinforcing device which can be readily coupled to or separated from a customary platform for the rear portion of the sole on a ski boot or another article of footwear which is connected to the ski by resorting to the improved binding.

The invention is embodied in a ski binding which comprises a frame forming part of a sole plate and including a front portion and a plurality (preferably two) of elongated frame members or arms extending rearwardly from the front portion (as considered in the skiing direction), a plurality of first detent means (e.g., one or more rows of notches) provided on at least one of the frame members (preferably on both frame members) and spaced apart from each other, as considered in the longitudinal direction of the one frame member, a plate or analogous means for coupling the front portion of the frame to a ski so as to enable the frame to pivot about an axis extending transversely of the skiing direction, and means for reinforcing the frame including a preferably metallic and preferably plate-like first or lower section disposed below the frame members and extending substantially transversely of the skiing direction, a second section which preferably consists of synthetic plastic material and is disposed above the frame members so as to at least partially overlie the lower section, and screws or analogous means for fastening the sections to each other. At least one of the sections (preferably the lower section) has second detent means which releasably engages selected first detent means on the one frame member (the second detent means preferably includes detent members having projections which engage first detent means on both frame members). The reinforcing means is movable lengthwise of the frame members upon disengagement of second detent means from the first detent means and/or vice versa. The binding further comprises means for connecting the reinforcing means to the foremost portion of the sole of a boot which is secured to the ski by the improved binding, and such connecting means preferably includes a yoke having coaxial end portions and bearings (e.g., eyelets) provided on one of the sections and receiving the end portions of the yoke so that the latter is pivotable about an axis extending transversely of the skiing direction. The upper section of the reinforcing means has an upper side serving as a rest for the sole of a boot which is connected to the ski by the improved binding.

At least one section of the reinforcing means is preferably formed with recesses for those portions of the frame members which are disposed between the upper and lower sections, and preferably also with recesses for the second detent means. Such recesses are preferably provided in the upper section of the reinforcing means. The latter is preferably mounted sufficiently close to the pivot axis for the frame to insure that the tip of the boot is located in immediate or close proximity to such axis.

The novel features which are considered as characteristic of the invention are set forth in particular in the appended claims. The improved binding itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 shows the underside of the upper section of the reinforcing means;

FIG. 4 illustrates the upper side of the upper section of the reinforcing means;

DESCRIPTION OF THE PREFERRED EMBODIMENTS

Figure 1:
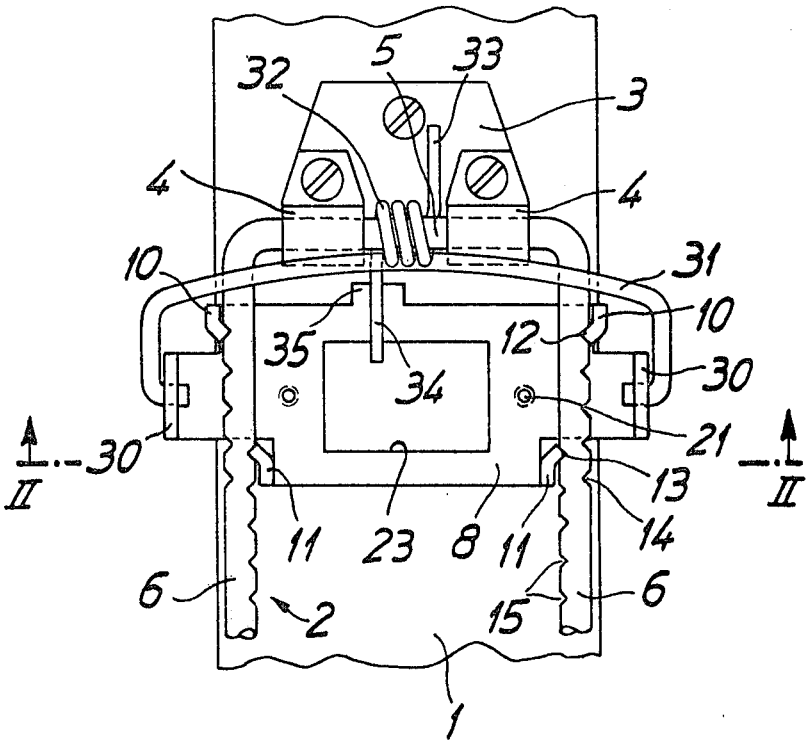
FIG. 1 is a fragmentary plan view of a ski and of a binding which embodies one form of the invention, with the upper section of the reinforcing means for the frame of the sole plate removed.

Referring first to FIGS. 1 to 4, there is shown a binding which is attached to a cross country ski 1. The binding comprises a sole plate 2 which is pivotally secured to the ski 1 by a platelike coupling member 3 enabling the sole plate to pivot about a horizontal axis which extends at right angles to the longitudinal direction of the ski. The coupling member 3 has two coaxial sleevelike bearing members 4 whose internal surfaces are lined with a suitable synthetic plastic material. The bearing members 4 receive a transversely extending front portion or crosshead 5 forming part of a frame of the sole plate 2. The frame further comprises two rearwardly extending parallel frame members or arms 6 which are adjacent to and extend in parallelism with the respective marginal portions of the ski 1. The rear end portions of the arms 6 are connected to each other by a rear portion (not shown) of the frame of the sole plate 2. The frame including the rear portion, the front portion 5 and the arms 6 is substantially rectangular and constitutes a support or base on which the ski boot rests.

The frame of the sole plate 2 is stiffened by a transversely extending reinforcing device 7 which is disposed behind the front portion 5 and one function of which is to rigidify the frame including the portion 5 and arms 6, i.e., to prevent twisting or other deformation of such frame. The reinforcing device 7 includes a plate-like lower section 8 which may (but need not) consist of a metallic material and an upper section 9 which may (but need not) consist of synthetic plastic material. The upper section 9 constitutes a rest or support for the adjacent portion of the boot.

Each marginal (lateral) portion of the lower section 8 has two upwardly projecting detent members or extensions 10, 11 which are disposed at the opposite sides of and closely adjacent the respective arm 6. Each extension 10 is located at a maximum distance from the associated extension 11, i.e., such distance is limited solely by the dimensions of the section 8, as considered in the longitudinal direction of the ski 1. As shown in FIG. 1, the extensions 10 are located at the front edge and the extensions 11 are located at the rear edge of the section 8. The front extensions 10 have inwardly extending tooth-shaped projections 12 which extend into adjacent female detent members or notches 14 at the outer sides of the respective arms 6. The rear extensions 11 have outwardly extending tooth-shaped projections 13 which extend into adjacent female detent members or notches 15 at the inner sides of the respective arms 6. FIG. 1 shows that each arm 6 comprises a row of preferably equally spaced outer notches 14 and a row of preferably equally spaced inner notches 15. At least some outer notches 14 are located forwardly of the foremost inner notches 15. Of course, it is equally within the purview of the invention to place the rear extensions 11 adjacent the outer sides of the respective arms 6 and to place the front extensions 10 adjacent the inner sides of such arms; in such bindings, the notches 14 and 15 are respectively provided in the inner and outer sides of the associated arms.

The just discussed symmetrical distribution of extensions 10 and 11 insures that the section 8 is securely but adjustably attached to the frame of the sole plate 2. In other words, the arms 6 cannot move lengthwise relative to the section 8 and/or relative to each other, and any and all forces which tend to twist and/or otherwise deform the frame are taken up by the section 8.

Figure 2:
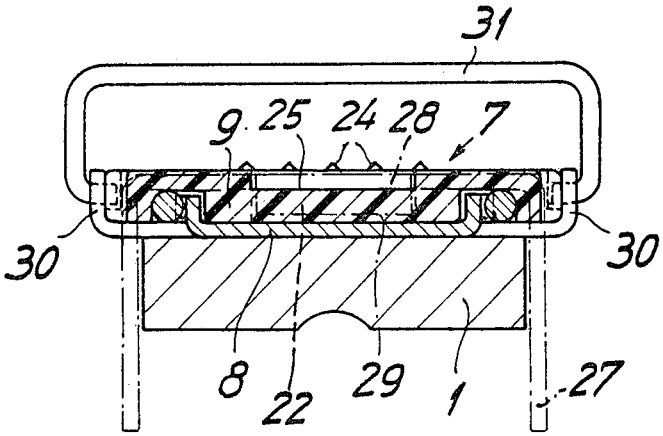
FIG. 2 is a transverse vertical sectional view as seen in the direction of arrows from the line II—II of FIG. 1.

The underside of the upper section 9 of the reinforcing device 7 has two sets of recesses or cutouts 17, 18 and 19 which respectively receive the corresponding arms 6, extensions 10 and extensions 11. In FIG. 3, the recesses 19 are located above the recesses 18 because the section 9 is shown in inverted position, i.e., from below. FIG. 2 shows that the section 9 completely overlies the section 8 so that the latter is always out of contact with the boot. The sections 8 and 9 are detachably secured to each other by screws or analogous fasteners, not shown. FIGS. 3 and 4 show holes 20 for such fasteners in the upper section 9, and FIG. 1 shows tapped holes 21 for threaded shanks of the fasteners. Any angular displacement of the upper section 9 relative to the lower section 8, or vice versa, is further prevented by the provision of a square, rectangular or otherwise configurated protuberance 22 which extends downwardly from the underside of the section 9 and into a complementary socket 23 in the upper side of the lower section 8. The positions of the protuberance 22 and socket 23 can be reversed. Alternatively, each of the sections 8, 9 can have one or more protuberances and sockets. The protuberance 22 contributes significantly to rigidity of the reinforcing device 7 and of the entire sole plate 2, especially since the arms 6 are received between the sections 8 and 9.

The upper side of the upper section 9 has longitudinally extending ridges or ribs 24 which are contacted by the underside of the sole of a ski boot.

The rear portion of the section 9 (i.e., that portion which is remote from the coupling member 3) has a depression or recess 25 provided in its upper side and located behind a transversely extending slot 26 for reception of a conventional ski climber 27 (indicated in FIG. 4 by phantom lines) which is clamped to the sole plate in the customary way and includes a forwardly extending tongue 28 received in the depression 25 and a ledge 29 which extends into the slot 26 of the section 9. The ledge 29 cooperates with the section 9 to determine the position of the ski climber 27, as considered in the longitudinal direction of the sole plate 2.

The lower section 8 of the reinforcing device 7 is further formed with laterally extending brackets having upwardly extending bearings in the form of eyelets 30 which receive the inwardly bent coaxial end portions of a yoke 31 serving to connect the reinforcing device 7 to the sole of a ski boot in front of the toe cap. The eyelets 30 provide a pivot for the yoke 31 and are located outside of the outline of the ski 1. The yoke 31 can be moved lengthwise of the arms 6 by displacing the reinforcing device 7 lengthwise of the ski 1 and by thereupon causing the projections 12, 13 of the extensions 10, 11 to enter the adjacent notches 14 and 15. Such adjustability of the yoke 31 lengthwise of the arms 6 is desirable in order to enable the skier to place the yoke in an optimum position with respect to the bearing members 4, i.e., to place the toe of the ski boot in an optimum position with respect to the coupling member 3.

The binding further comprises means for biasing the reinforcing device 7 toward the upper side of the ski 1. The illustrated biasing means comprises a torsion spring 32 which is coiled around the front portion 5 between the bearing members 4 and one leg (33) of which bears against the upper side of the coupling member 3. The other leg 34 of the torsion spring 32 bears against a forwardly extending projection or lug 35 of the lower section 8. Alternatively, the leg 34 can extend into an elongated hole or bore in the upper section 9 of the reinforcing device 7. It is preferred to use a torsion spring with a relatively long leg 34 to thus insure that the reinforcing device 7 is biased toward the ski in each and every position of its adjustment relative to the arms 6. The purpose of the spring 32 is to urge the entire sole plate 2 toward the upper side of the ski 1 with a force which is sufficient to guarantee that, when the skier lifts the heel of his or her boot above and away from the ski, i.e., when the sole plate 2 is pivoted about the axis defined by the bearing members 4, the rear end of the ski is lifted with the heel and is out of contact with the ground during foward movement of the ski. This reduces the likelihood of rapid tiring of the user, especially in the course of a cross country race. The torsion spring 32 can be replaced with two or more weaker torsion springs, with one or more leaf springs or other suitable biasing means.

An important advantage of the relatively simple, lightweight and inexpensive reinforcing device 7 is that it positively prevents any twisting or other deformation of the frame including the front portion 5 and frame members or arms 6 in spite of the fact that the device 7 is readily adjustable lengthwise of the arms. Any shifting of arms 6 relative to each other, e.g., to positions out of parallelism with the adjacent marginal portions of the ski 1, would tend to change the orientation of the front portion 5 and would subject the bearing members 4 to very pronounced stresses which, in turn, would result in rapid wear upon such bearing members. Stiffening of the frame is attributable to the provision of detent means 10–15, to the provision of recesses 17 to 19 for those portions of arms 6 which are disposed between the sections 8, 9 of the reinforcing device 7 and for the extensions 10, 11, to the provision of fasteners which secure the sections 8, 9 to each other, and to the provision of protuberance 22 and socket 23. Furthermore, such stiffening is attributable to the fact that the reinforcing device 7 is located rather close to the front portion 4 of the frame.

Adjustability of the reinforcing device 7 in the longitudinal direction of the arms 6 (i.e., in the skiing direction) renders it possible to locate the foremost part of a boot at an optimum distance from (preferably in immediate proximity to) the pivot axis which is defined by the bearing members 4 of the coupling plate 3. Also, the binding can utilize a very simple and inexpensive means (yoke 31 and bearings or eyelets 30) which connect the foremost portion of the sole of a boot to the reinforcing device 7. This will be readily appreciated since the yoke 31 shares all movements of the device 7 relative to the arms 6 when the device 7 is moved toward or away from the bearing members 4.

It has been found that the aforedescribed distribution of extensions 10, 11 (i.e., in such a way that an extension 10 engages the outer side and an extension 11 engages the inner side of the associated arm 6) is particularly advantageous to insure a highly desirable stiffening of the frame. As mentioned above, satisfactory stiffening or reinforcement of the frame prolongs the useful life of bearings 4 for the front portion 5 of the frame. Moreover, satisfactory stiffening of the frame enables the skier to readily control the direction of movement of the skis because the skis can immediately respond to any and all forces which the boots transmit to the respective bindings.

As mentioned above, the protuberance 22 is preferably provided at the underside of the upper section 9. This protuberance (especially if it extends into a complementary socket 23 of the section 8) contributes to rigidity of the device 7 and hence to stiffness of the frame. Any turning of the section 9 relative to the arms 6 about a vertical axis is further prevented because the arms 6 extend into the recesses 17 in the underside of the section 9. In other words, both sections of the reinforcing device 7 cooperate to prevent any turning of the device 7 relative to the frame.

The slot 26, which receives the ledge 29 of the ski climber 27, insures that the ski climber cannot move lengthwise of the reinforcing device 7. The ledge 29 is preferably received in the slot 26 with a relatively small amount of clearance to prevent lateral shifting of the ski climber 27. The likelihood of such lateral shifting is further reduced by the provision of depression 25 for the tongue 28 of the ski climber 27. The provision of a relatively simple coupling between the ski climber 27 and the reinforcing device 7 is particularly desirable in bindings for cross country skis because the weight of such bindings should be kept to a minimum for obvious reaons.

If the plastic material of the upper section 9 is relatively soft, the slot 26 may be provided in the metallic lower section 8. To this end, a portion of the section 8 can be surrounded by a U-shaped slit and bent upwardly from the general plane of this section to provide a slot and an upwardly extending barrier behind the slot. The ledge 29 then extends upwardly through the slot of the section 8 and abuts against the front surface of the barrier.

The material of the plastic section 9 (or at least the material of the ribs 24) can be selected with a view to reduce friction between the ribs and the sole of a boot which is connected to the ski 1.

Figure 5:
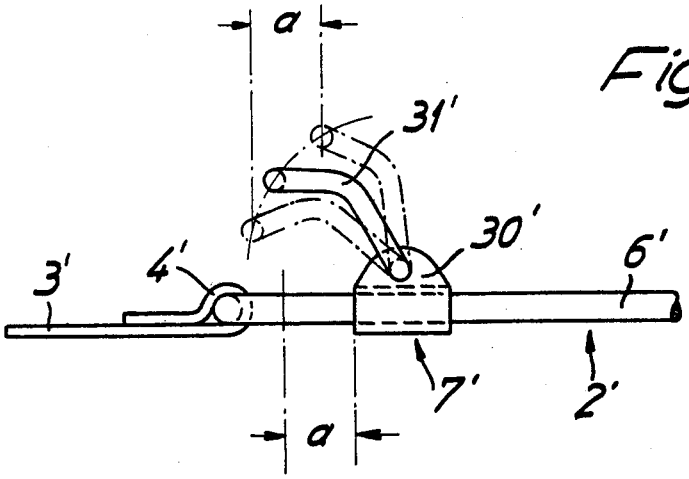
FIG. 5 is a side elevational view of a portion of a modified binding, with the sole-engaging yoke of the binding shown in several positions.
Figure 6:
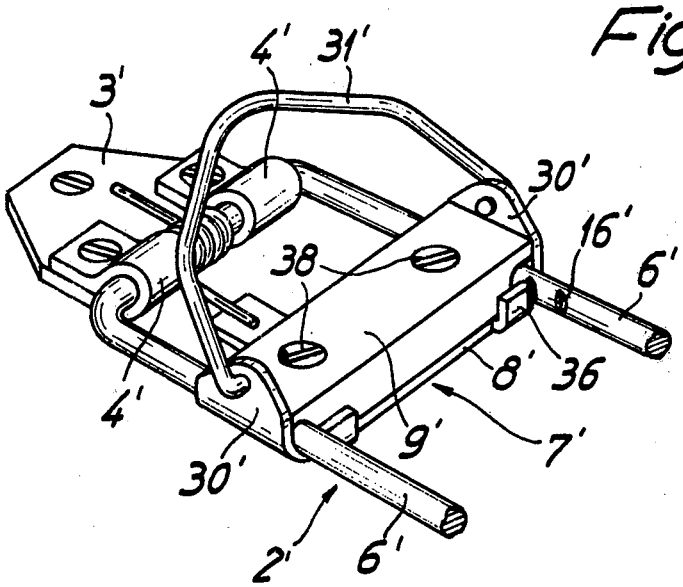
FIG. 6 is a fragmentary perspective view of the modified binding.
Figure 7:
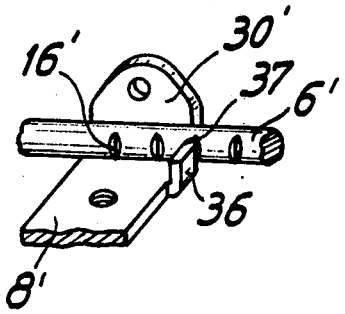
FIG. 7 is a perspective view of a detail in the binding of FIG. 6.

FIGS. 5 to 7 illustrate a second binding wherein all such parts which are identical with or clearly analogous to corresponding parts of the first binding are denoted by similar reference characters each followed by a prime. The configuration of the yoke 31′ deviates somewhat from that of the yoke 31. Also, the lower section 8′ of the reinforcing device 7′ is simpler than the section 8. As shown in FIGS. 6 and 7, the section 8′ is relatively narrow (as considered in the longitudinal direction of the ski) and has only two male detent members or extensions 36 provided with toothed projections 37 received in adjacent notches 16′ provided in the respective frame members or arms 6′ (the notches in the left-hand arm 6′ of FIG. 6 are concealed, the same as the corresponding projection 37). The notches 16′ are provided at the inner sides of the arms 6′. The bearings or eyelets 30′ perform the dual function of providing a pivot axis for the yoke 31′ as well as of abutting against the respective arms 6′ opposite the associated extensions 36. The means for separately securing the sections 8′, 9′ of the reinforcing device 7′ to each other comprises screws 38 or analogous fasteners. The arms 6′ (as well as the arms 6) are at least slightly flexible to enable a skier to move the extensions into and from the adjacent notches when the sections 9, 9′ are respectively separated from the sections 8, 8′.

FIG. 5 shows that the angular position of the yoke 31′ depends on the thickness of the sole in front of the toe of a ski boot. If the sole is relatively thin, the yoke 31′ will assume the lowermost position of FIG. 5 (such position is indicated by phantom lines, the same as the uppermost position which the yoke 31′ assumes when it engages a relatively thick sole). In other words, the web or central portion of the yoke 31′ moves nearer to the bearing members 4′ if the yoke engages a relatively thin sole. A normal position of the yoke 31 (when the yoke engages a sole of medium or average thickness) is indicated in FIG. 5 by solid lines. The distance (as considered in the longitudinal direction of the ski) between the two end positions of the sole-engaging web of the yoke 31′ is shown at *a*; such distance can be assumed to equal or approximate the distance (also denoted by *a*) between the web of the yoke 31′ and the front edge of the section 8′ of reinforcing device 7′ when the yoke 31′ engages a sole of average thickness. It will be noted that, when the yoke 31′ engages a relatively thick sole, the boot is located at a relatively great distance from the pivot axis for the yoke. This can be compensated for by adjusting the reinforcing device 7′ lengthwise of the arms 6′ (i.e., by introducing the projections 37 of the extensions 36 into a different pair of notches 16′).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above-described contribution to the art and, therefore, such adaptations should and are intended to be comprehended within the meaning and range of equivalence of the appended claims.

What is claimed is:

1. In a ski binding, a combination comprising a frame including a front portion and a plurality of elongated frame members extending rearwardly from said front portion, as considered in the skiing direction, at least one of said frame members having a plurality of first detent means spaced apart from each other, as considered longitudinally of said one frame member; means for coupling said front portion to a ski so as to enable said frame to pivot about an axis extending transversely of the skiing direction; means for reinforcing said frame, including a first section located below said frame members, a second section located above said frame members and at least partially overlying said first section, and means for fastening said sections to each other, said second section having an upper side which is contacted by the sole of a boot that is secured to the ski by said binding and at least one of said sections having second detent means releasably engaging selected first detent means of said one frame member to normally hold said one section against any movement lengthwise of said one frame member, said reinforcing means being movable lengthwise of said frame members solely upon disengagement of said first and second detent means from each other; and means for connecting said reinforcing means to the foremost portion of the sole of a boot which is secured to the ski, including a sole-engaging yoke and bearings provided on one of said sections and defining for said yoke a pivot axis extending transversely of the skiing direction.

2. A combination as defined in claim 1, wherein each of said frame members is a substantially straight arm and said arms are substantially parallel to each other, one of said detent means comprising notches and the other of said detent means comprising projections receivable in selected notches.

3. A combination as defined in claim 2, wherein said notches are provided in said arms and said projections are provided on said first section of said reinforcing means.

4. A combination as defined in claim 1, wherein said frame members include substantially parallel first and second frame members which are spaced apart from each other, as considered transversely of the skiing direction, each of said first and second frame members having first detent means and said second detent means including detent means engageable with the first detent means of each of said first and second frame members.

5. A combination as defined in claim 1, wherein said bearings include two eyelets provided on said first section and said yoke includes coaxial end portions passing through said eyelets.

6. A combination as defined in claim 1, wherein one of said sections has recesses for those portions of said frame members which are disposed between said sections.

7. A combination as defined in claim 1, wherein said reinforcing means is adjacent said front portion of said frame.

8. A combination as defined in claim 1, further comprising a ski climber disposed behind said reinforcing means and means for coupling said ski climber to said reinforcing means.

9. A combination as defined in claim 1, further comprising means for biasing said frame against the ski.

10. In a ski binding, a combination comprising a frame including a front portion and a plurality of elongated frame members including substantially parallel first and second frame members extending rearwardly from said front portion, as considered in the skiing direction, said first and second frame members being spaced apart from each other, as considered transversely of the skiing direction, and each of said first and second frame members having a plurality of first detent means spaced apart from each other, as considered longitudinally of the respective frame members, said first detent means including notches provided in said first and second frame members; means for coupling said front portion to a ski so as to enable said frame to pivot about an axis extending transversely of the skiing direction; means for reinforcing said frame, including a first section located below said frame members, a second section located above said frame members and at least partially overlying said first section, and means for fastening said sections to each other, said second section having an upper side which is contacted by the sole of a boot that is secured to the ski by said binding and at least one of said sections having second detent means releasably engaging selected first detent means of said first and second frame members, said second detent means comprising extensions projecting upwardly from said first section and having projections extending into selected notches of said first and second frame members, said reinforcing means being movable lengthwise of said frame members upon disengagement of said first and second detent means from each other; and means for connecting said reinforcing means to the foremost portion of the sole of a boot which is secured to the ski, including a sole-engaging yoke and bearings provided on one of said sections and defining for said yoke a pivot axis extending transversely of the skiing direction.

11. In a ski binding, a combination comprising a frame including a front portion and a plurality of elongated frame members including substantially parallel first and second frame members extending rearwardly from said front portion, as considered in the skiing direction, said first and second frame members having a plurality of first detent means spaced apart from each other, as considered longitudinally of the respective frame members, said first detent means including a first row of notches provided in that side of each of said first and second frame members which faces away from the other of said first and second frame members and a second row of notches provided in that side of each of said first and second frame members which faces the other of said first and second frame members; means for coupling said front portion to a ski so as to enable said frame to pivot about an axis extending transversely of the skiing direction; means for reinforcing said frame, including a first section located below said frame members, a second section located above said frame members and at least partially overlying said first section, and means for fastening said sections to each other, said second section having an upper side which is contacted by the sole of a boot that is secured to the ski by said binding and at least one of said sections having second detent means releasably engaging selected first detent means of said first and second frame members, said second detent means including two first extensions located at the forward end of the respective section, as considered in the skiing direction, and two second extensions located at the rear end of the respective section, said first extensions having projections received in selected ones of said first rows of notches and said second extensions having projections received in selected ones of said second rows of notches so that each of said first and second frame members is disposed between a first and a second extension, said reinforcing means being movable lengthwise of said frame members upon disengagement of said first and second detent means from each other; and means for connecting said reinforcing means to the foremost portion of the sole of a boot which is secured to the ski, including a sole-engaging yoke and bearings provided on one of said sections and defining for said yoke a pivot axis extending transversely of the skiing direction.

12. A combination as defined in claim 11, wherein said extensions are rigid with said first section and said projections of said extensions extend from the respective extensions toward the associated frame members.

13. In a ski binding, a combination comprising a frame including a front portion and a plurality of elongated frame members extending rearwardly from said front portion, as considered in the skiing direction, at least one of said frame members having a plurality of first detent means spaced apart from each other, as considered longitudinally of said one frame member; means for coupling said front portion to a ski so as to enable said frame to pivot about an axis extending transversely of the skiing direction; means for reinforcing said frame, including a first section located below said frame members, a second section located above said frame members and at least partially overlying said first section, and means for fastening said sections to each other, said second section having an upper side which is contacted by the sole of a boot that is secured to the ski by said binding and at least one of said sections having second detent means releasably engaging selected first detent means of said one frame member, one of said sections having a non-circular protuberance received in a complementary socket of the other of said sections to prevent turning of said sections relative to each other, said reinforcing means being movable lengthwise of said frame members upon disengagement of said first and second detent means from each other; and means for connecting said reinforcing means to the foremost portion of the sole of a boot which is secured to the ski, including a sole-engaging yoke and bearings provided on one of said sections and defining for said yoke a pivot axis extending transversely of the skiing direction.

14. A combination as defined in claim 13, wherein said protuberance has a polygonal outline and is provided on said second section.

15. In a ski binding, a combination comprising a frame including a front portion and a plurality of elongated frame members extending rearwardly from said front portion, as considered in the skiing direction, at least one of said frame members having a plurality of first detent means spaced apart from each other, as considered longitudinally of said one frame member; means for coupling said front portion to a ski so as to enable said frame to pivot about an axis extending transversely of the skiing direction; means for reinforcing said frame, including a first section located below said frame members, a second section located above said frame members and at least partially overlying said first section, and means for fastening said sections to each other, said second section having an upper side which is contacted by the sole of a boot that is secured to the ski by said binding and at least one of said sections having second detent means releasably engaging selected first detent means of said one frame member, said reinforcing means being movable lengthwise of said frame members upon disengagement of said first and second detent means from each other; means for connecting said reinforcing means to the foremost portion of the sole of a boot which is secured to the ski, including a sole-engaging yoke and bearings provided on one of said sections and defining for said yoke a pivot axis extending transversely of the skiing direction; a ski climber disposed behind said reinforcing means; and means for coupling said ski climber to said reinforcing means, including a slot provided in said reinforcing means and a ledge forming part of said ski climber and extending into said slot.

16. A combination as defined in claim 15, wherein said reinforcing means has a depression disposed behind said slot and said ski climber has a tongue received in said depression and rigid with said ledge.

17. In a ski binding, a combination comprising a frame including a front portion and a plurality of elongated frame members extending rearwardly from said front portion, as considered in the skiing direction, at least one of said frame members having a plurality of first detent means spaced apart from each other, as considered longitudinally of said one frame member; means for coupling said front portion to a ski so as to enable said frame to pivot about an axis extending transversely of the skiing direction; means for reinforcing said frame, including a first section located below said frame members, a second section located above said frame members and at least partially overlying said first section, and means for fastening said sections to each other, said second section having an upper side which is contacted by the sole of a boot that is secured to the ski by said binding and at least one of said sections having second detent means releasably engaging selected first detent means of said one frame member, said reinforcing means being movable lengthwise of said frame members upon disengagement of said first and second detent means from each other; means for connecting said reinforcing means to the foremost portion of the sole of a boot which is secured to the ski, including a sole-engaging yoke and bearings provided on one of said sections and defining for said yoke a pivot axis extending transversely of the skiing direction; and means for biasing said frame against the ski, including a resilient element reacting against said coupling means and bearing against said reinforcing means.

18. A combination as defined in claim 17, wherein said resilient element is a torsion spring having convolutions surrounding said front portion of said frame, a first leg engaging said coupling means, and a second leg engaging said reinforcing means.

* * * * *